US008631870B2

(12) United States Patent
Johnson et al.

(10) Patent No.: US 8,631,870 B2
(45) Date of Patent: Jan. 21, 2014

(54) SNUBBING TUBULARS FROM A SAGD WELL

(75) Inventors: Blake Johnson, Red Deer (CA); Conrad Petrowsky, Red Deer (CA); Thomas Gerard Follett, Red Deer (CA)

(73) Assignee: 1440072 Alberta Ltd., Red Deer (CA)

( * ) Notice: Subject to any disclaimer, the term of this patent is extended or adjusted under 35 U.S.C. 154(b) by 328 days.

(21) Appl. No.: 12/846,526

(22) Filed: Jul. 29, 2010

(65) Prior Publication Data

US 2011/0048734 A1 Mar. 3, 2011

Related U.S. Application Data

(60) Provisional application No. 61/229,898, filed on Jul. 30, 2009.

(51) Int. Cl.
*E21B 36/00* (2006.01)
*E21B 19/00* (2006.01)

(52) U.S. Cl.
USPC ..... 166/302; 166/57; 166/84.2; 166/377

(58) Field of Classification Search
USPC ..... 166/302, 57, 84.2, 377; 165/104.1
See application file for complete search history.

(56) References Cited

U.S. PATENT DOCUMENTS

| | | | | |
|---|---|---|---|---|
| 3,212,581 | A * | 10/1965 | Marshall | 166/84.2 |
| 3,468,374 | A * | 9/1969 | Reeves | 166/84.2 |
| 7,128,156 | B2 * | 10/2006 | McClung, III | 166/302 |
| 7,762,321 | B2 * | 7/2010 | Fesi et al. | 166/105 |
| 8,235,107 | B2 * | 8/2012 | Fesi et al. | 166/105 |
| 2005/0205260 | A1 * | 9/2005 | McClung, III | 166/302 |
| 2007/0261841 | A1 * | 11/2007 | Fesi et al. | 166/105 |
| 2008/0110613 | A1 * | 5/2008 | Holte et al. | 166/84.2 |
| 2011/0014064 | A1 * | 1/2011 | Fesi et al. | 417/58 |
| 2011/0024120 | A1 | 2/2011 | Jensen | |
| 2011/0048734 | A1 * | 3/2011 | Johnson et al. | 166/377 |

FOREIGN PATENT DOCUMENTS

| | | | |
|---|---|---|---|
| CA | 2 271 511 | C | 10/2003 |
| CA | 2 447 196 | A1 | 4/2004 |
| CA | 2 344 744 | C | 6/2006 |

* cited by examiner

*Primary Examiner* — Jennifer H Gay
(74) *Attorney, Agent, or Firm* — Bennett Jones LLP

(57) ABSTRACT

For SAGD operations, an apparatus and method of stripping and cooling tubing is provided by a cooling chamber where tubing and associated equipment can be safely exposed to a coolant fluid before significant handling. A telescoping chamber with a work window permits cables to be detached from tubing during stripping. Coolant may be Nitrogen or similarly inert fluid.

6 Claims, 10 Drawing Sheets

SNUBBING TUBULARS FROM A SAGD WELL

CROSS REFERENCE TO RELATED APPLICATIONS

The present application claims priority to U.S. provisional application Ser. No. 61/229,898 filed Jul. 30, 2009.

The present invention relates to a method and apparatus for snubbing pipe from a SAGD production or steam well.

BACKGROUND OF THE INVENTION

Snubbing is often performed to remove pipe string from an oil or gas well while the well is still live (i.e. under pressure) and avoid having to kill the well (i.e. reducing the pressure in the well). Pipe strings are formed of numerous pipe joints connected together. Unlike wireline and coiled tubing, which have a uniform outer diameter along the entire length of their run down hole, the pipe joints have collars or flanges at their ends which are used to connect the pipe joints together. These collars are larger than the outer diameter of the pipe joint. Therefore, to snub a pipe string out of a well, these collars must be accommodated while maintaining the pressure in the well bore.

Snubbing is typically done on pipe strings in conventional oil and gas wells. For SAGD operations (steam assisted gravity drainage), snubbing operations are typically not performed. Although SAGD operations commonly use pipe strings in the production wells, the SAGD process creates problems with the snubbing process. Commonly, if a pipe string or a section of a pipe string has to be removed from a SAGD well, the well is typically killed and then the pipe string is removed after the well has been killed.

One of the problems encountered with trying to snub a SAGD well is the temperature of the pipe string in a SAGD operation. SAGD operations typically use a pair of vertically spaced, horizontal well bores to collect heavy oil from a formation. The higher of the two well bores has a steam string and the lower a production string. Steam is pumped down the higher of the well bore through the steam string into the heavy oil formation where the steam heats the heavy oil, decreasing its viscosity and allowing it to flow. Gravity can then cause this heavy oil to flow downwards in the formation and into the lower horizontal well bore where it can enter the production string and be pumped up to the surface. Because the heavy oil has been heated by the steam, the steam strings and production string are subjected to elevated temperatures by the heated heavy oil.

When a SAGD well is killed, the pressure in the well is bled off and the well is cooled. However, killing a SAGD well before removing a pipe string does have disadvantages. Killing the SAGD well can result in significant downtime for the well. Once the pressure in the well has been bled of and cooled and the pipe string removed and reinstalled in the well, the formation will have to be reheated to once again get the heavy oil in the formation flowing. Steam injection will have to be restarted to the formation and the time required to get the formation up to a producing temperature can result in significant downtime.

SUMMARY OF THE INVENTION

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

The invention provides an apparatus for cooling tubulars stripped from a well to temperatures suitable for handling at surface, comprising a hanger for manipulating the tubular above a top annular BOP or seal which is above a bottom annular BOP or seal which is attached to and above the well's wellhead, a chamber attached between those BOPs or seals sealed by those BOPs or seals from wellbore pressures and atmosphere for receiving tubulars and associated equipment from the wellbore, a fluid coolant, the chamber with an inlet port for injection of coolant and an outlet port for exhausting coolant; in one instance or embodiment, where the chamber is expandable in length while sealed; or where there is a work window 4*a* in the chamber or above the top BOP or seal and below the hanger; or where collecting and redeploying means is provided for cable removed or replaced from or to the tubing through the window during removal or reinjection of tubing from or to the wellbore with the wellbore being continuously sealed from atmosphere at surface; or where the expansion and contraction of the expandable chamber is by telescoping a concentrically arranged series of nested tubes, each sealed to the next to provide a sealed telescopic chamber sufficient in diameter to receive tubulars and associated equipment from a wellbore.

In another embodiment, the invention provides for a method of removing and cooling tubing from a wellbore under pressure isolating the tubing from atmosphere by flowing a coolant fluid under pressure within a chamber isolating the tubing from atmosphere and the wellbore and exposing the tubing to the coolant, comprising the steps of:

(a) attaching a hanger to the tubing in the wellbore—using the hanger and associated service rig equipment to strip the tubing from the wellbore through an apparatus, the apparatus having at least one annular BOP and/or seal above the wellbore, a chamber above that BOP/seal to hold the tubing, a second annular BOP/seal above the chamber and below the hanger, the chamber having ports to receive and exhaust the coolant, the tubing having sufficient dwell time within the coolant to become cool enough for handling at surface; and (b) stripping the tubing further from the apparatus to above the second BOP/seal for further operations.

In another embodiment, for simultaneously removing cabling attached to the tubing while stripping through the apparatus, the apparatus further comprising the chamber having capacity to expand along the length of the tubing and a work window above the second BOP/seal but below the hanger to permit removal of the cabling from the tubing once the tubing is cooled during stripping, the method further comprising the steps:

(c) fully extending the expandable chamber while cooling the included tubing during stripping (d) stopping stripping operations (e) contracting the expandable chamber while removing cabling from the tubing as it is exposed to the work window during contraction (f) resuming stripping and simultaneously expanding the chamber until fully expanded while cooling a new section of the tubing; and (g) repeating as necessary.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
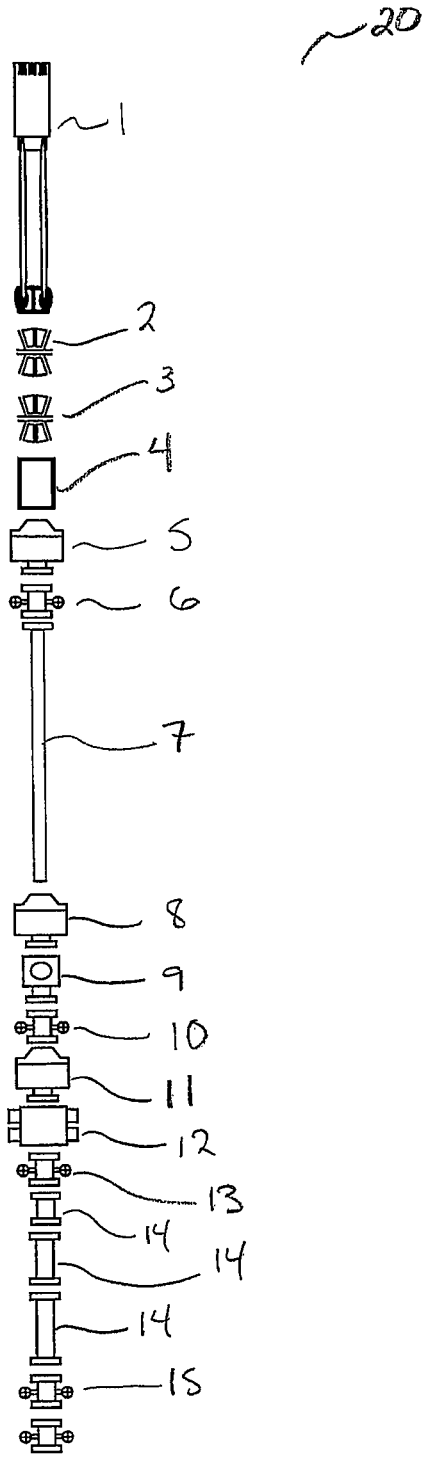
FIG. 1 is a schematic illustration of a BOP stack.

FIG. 1 illustrates a BOP stack 20 that can be used to perform the methods described herein.

The BOP stack 20 can be made up of a rig blocks 1, an upper slips 2, a lower slips 3, a work window 4, an upper BOP 5, a ported spool 6, a scoping spool 7, a intermediate BOP 8, a single gate BOP 9, a ported spool 10, a lower BOP 11, a double gate BOP 12, a ported spool 13, a plurality of spacer spools 14, and a final ported spool 15.

The BOP stack 20 can be attached to a casing flange 16 for a well that contains a pipe string to be snubbed out of the well.

The rig block 1 is attachable to an end of a section of pipe string in the BOP stack 20 and can be used to hoist the section of pipe string up through the BOP stack 20. The rig block 1 can be used if the pipe string is always in a pipe heavy situation (i.e. the weight of the pipe string is greater than the pressure in the well causing the force of the pipe string on the rig block 1 to be downwards).

The upper slips 2 and the lower slips 3 are used to selectively grip and release a tubular, such as a pipe joint. The upper slips 2 and lower slips 3 can be engaged to grip a pipe joint and then disengaged to release the pipe joint. The upper slips 2 can be anchored by the rig block 1, stationary platform, jack plates, etc. If jack plates are used, the jack plates can be operated by hydraulics, cable, rack and pinion, ball and screw, chain, etc. The upper slips 2 is only needed when the pipe string being snubbed is in a pipe light state with the weight of the pipe string being less than the force imposed on the pipe string by the pressure in the well. In this situation, the greater force on the pipe string by the pressure in the well causing the pipe string to want to move upwards. The lower slips 3 can be moved by a jack plate operated by hydraulics, cable, rack and pinion, ball and screw, chain, etc.

The work window 4 allows access to the pipe string in the BOP stack 20, it can be used to allow a person to gain access to a pipe joint and remove cabling connected to the pipe string.

The upper BOP 5 can be a blowout preventer designed to selectively seal around a tubular component, such as a spherical BOP, annular BOP, etc. During the snubbing of a pipe string it will open and close (seal) around a pipe joint being snubbed out of the well using the BOP stack 20.

The ported spools 6, 10, 13, 15 can all be spools with one or more ports allowing a fluid to be injected and/or removed from the interior of these ported spools 6, 10, 13 and 15. In the case of the BOP stack 20, the ported spool 6 is optional but will give a far greater cooling effect to a pipe string in the BOP stack 20 if it is used.

The scoping spool 7 can be a solid tube or a telescopic tube to accommodate the amount of travel required by the upper BOP 5.

The intermediate BOP 8 can be a blowout preventer designed to selectively seal around the scoping spool 7. Alternatively, if the scoping spool 7 is something other than a solid tube, such as a telescopic tube, the intermediate BOP 8 can be substituted with a suitable engineered well bore device to conform to the scoping spool 7.

The single gate BOP 9 and the double gate BOP 12 can be ram or gate blowout preventers as is commonly known in the art that can be used to close off the well in the event of a blowout or other event.

The lower BOP 11 can be a blowout preventer designed to selectively seal around a tubular component, such as a spherical BOP, annular BOP, etc. During the snubbing of a pipe string it will open and close (seal) around a pipe joint being snubbed out of the well using the BOP stack 20.

Although FIG. 1 illustrates one embodiment of the BOP stack 20, a person skilled in the art will appreciate that the various components might be placed in a different order, some of the components may be replaced with similar/equivalent components and/or some components removed in particular circumstances.

Figure 2:
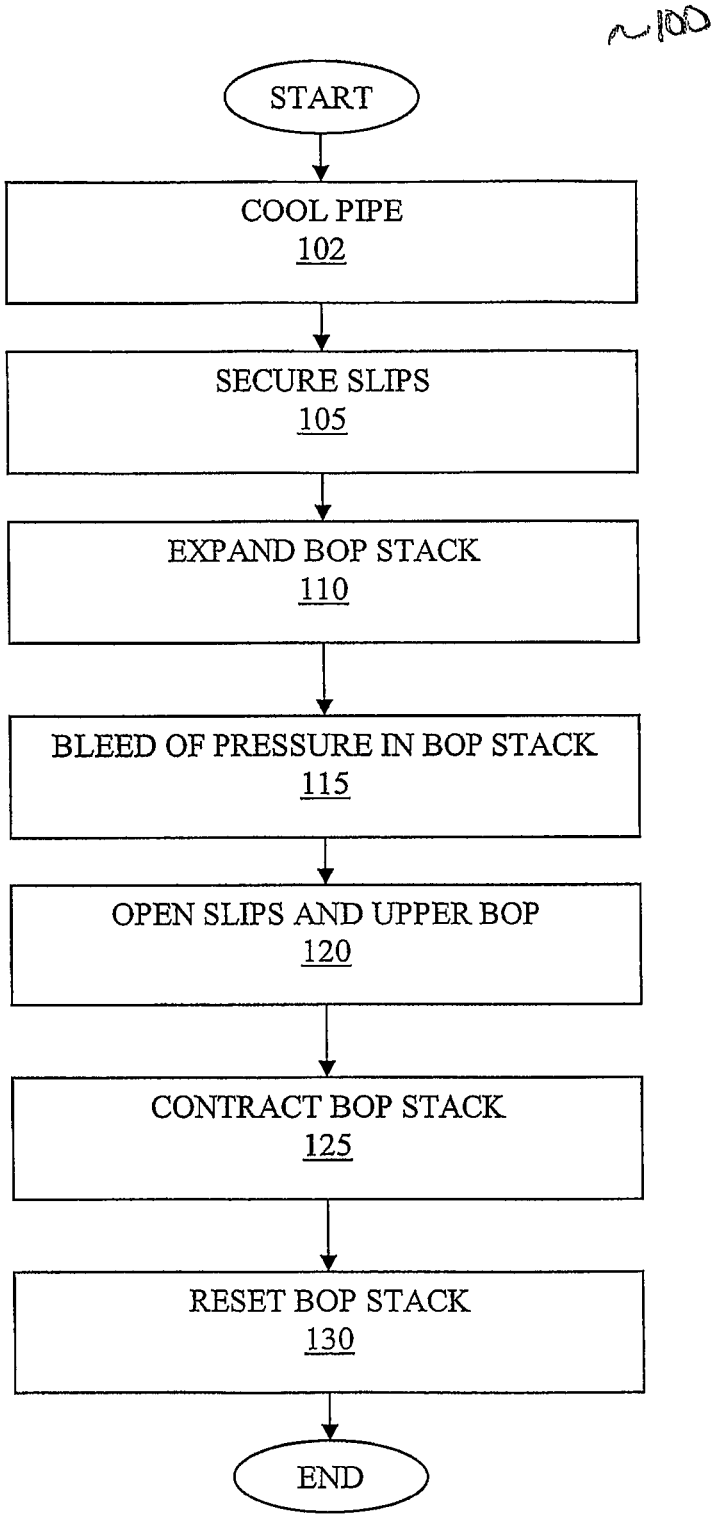
FIG. 2 is a flowchart of a method for snubbing a section of pipe string from a SAGD well.

FIG. 2 is a flowchart illustrating a method 100 of snubbing a section of pipe string 50 from a well of a SAGD operation. Method 100 can be used when the pipe string is in a pipe heavy condition (the weight of the pipe string is greater than the pressure in the well causing the force of the pipe string to be downwards).

Referring to FIGS. 1 and 2, the method 100 begins and at step 102 a section of pipe string 50 can be cooled before it is pulled out of the BOP stack 20.

Figure 3:
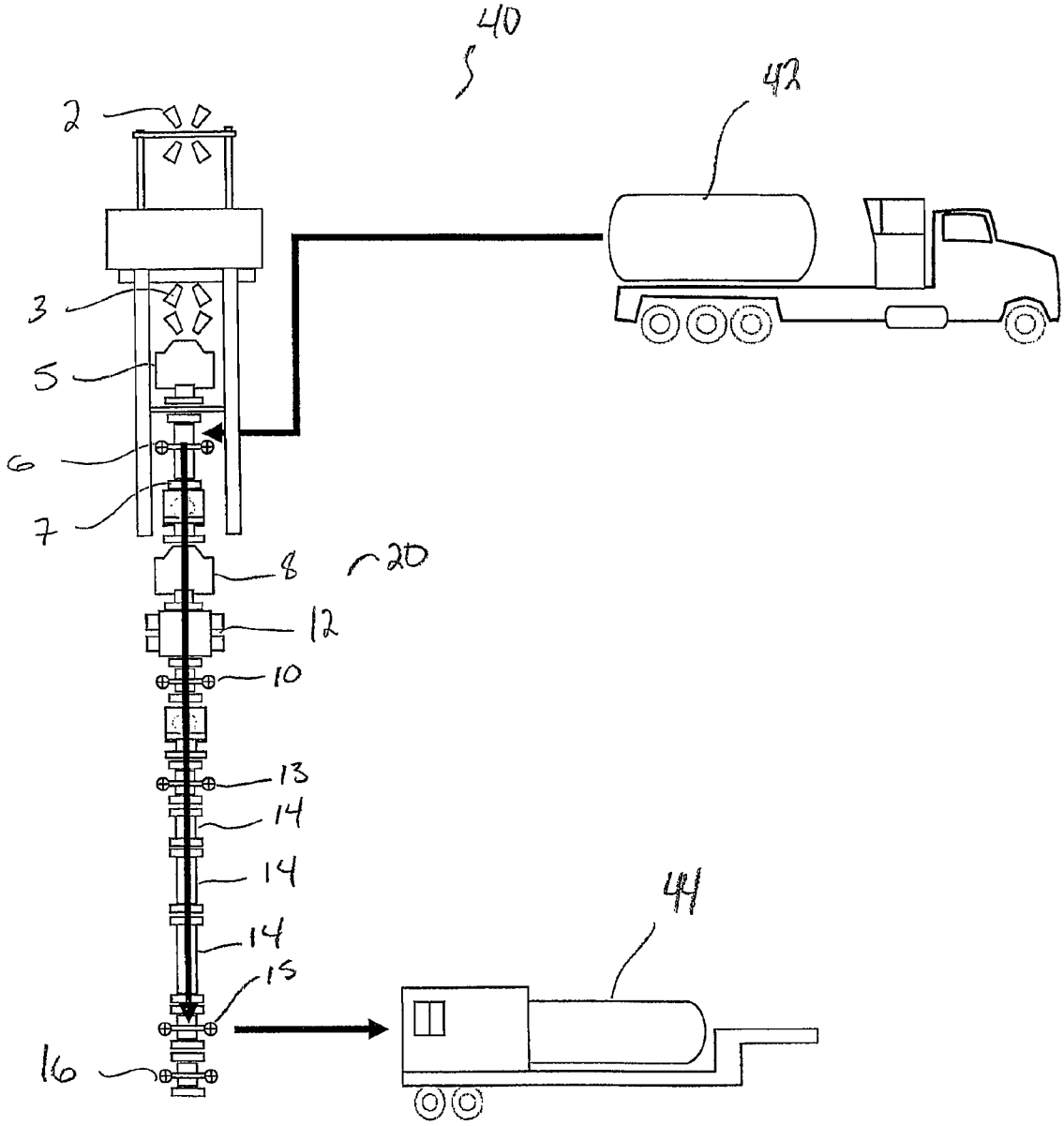
FIG. 3 is a schematic illustration of a cooling system for the BOP stack of FIG. 1.

FIG. 3 illustrates a cooling setup 40 for the BOP stack 20. A gas source 42 (in FIG. 3 case a tanker truck having a tank of compressed gas is shown, however, a person skilled in the art can appreciate that various different types of gas sources could be used). The gas source 42 can supply a cooling gas to the ported spool 6 proximate a top end of the BOP stack 20. In one aspect the cooling gas is an inert gas such as nitrogen, etc. For example, the cooling gas can be pumped into the interior of the BOP stack 20 through the ported spool 6 at approximately 10 $m^3$/min and at approximately 5-15° C. The cooling gas can be removed from the interior of the BOP stack 20 through the ported spool 15 located proximate the bottom of the BOP stack 20, causing the cooling gas to flow through the interior of the BOP stack 20 from proximate the top end to proximate the bottom end of the BOP stack 20.

The removal of the inert gas through the ported spool 15 can be done at a specific rate relative to the inflow rate of the cooling gas through the ported spool to control the back pressure of the cooling gas inside the interior of the BOP stack 20. FIG. 3 illustrates the cooling gas being removed from the interior of the BOP stack 20 to a test vessel 44. In this manner, the flow of cooling gas through the interior of the BOP stack 20 can be controlled at a desirable rate.

By introducing the cooling gas into the interior of the BOP stack 20, the cooling gas can come into contact and flow around the section of pipe string contained within the interior of the BOP stack 20, cooling the section of pipe string before it is removed from the BOP stack 20.

Although FIG. 3 illustrates the cooling gas being introduced into the interior of the BOP stack 20 through the ported spool 6, a person skilled in the art will appreciate that the cooling gas could also be introduced through either of the ported spools 10, 13. However, if the cooling gas is introduced through one of these ported spools 10, 13, the portion of the pipe string that comes in contact with the cooling gas can be reduced.

The plurality of the spacer spools 14 can increase the amount of the pipe section that is exposed to the cooling gas. With the cooling gas being removed from the interior of the BOP stack 20, through the ported spool 15, the more spacer spools 14 and the longer their length, the more of the pipe string that gets subjected to the cooling gas.

Figure 4:
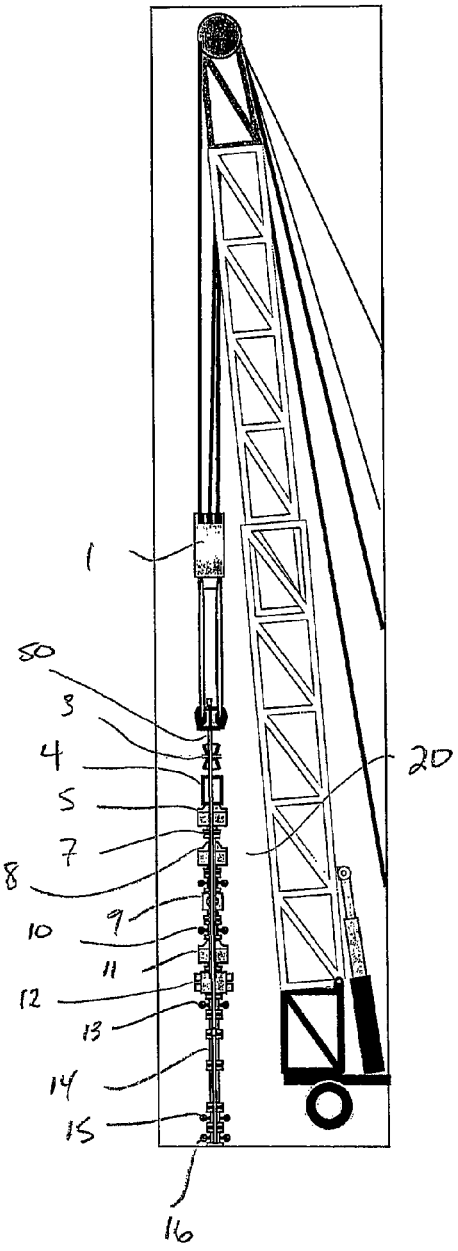
FIGS. 4-9 illustrate the steps of the method shown in the flowchart of FIG. 2.

Referring again to FIGS. 1 and 2, with the section of pipe string 50 having been cooled at step 102, the method 100 can move onto step 105 and the lower slips 3 can be tightened around the section of pipe string 50 to securely attach to the section of pipe string 50, as shown in FIG. 4 (the upper slips 2 are not shown in FIGS. 4-9 because they are not required in a pipe heavy situation). All of the BOPs below the upper BOP 5 and the intermediate BOP 8 should be open, placing the interior of the BOP stack 20 in fluid communication with the well.

Figure 5:
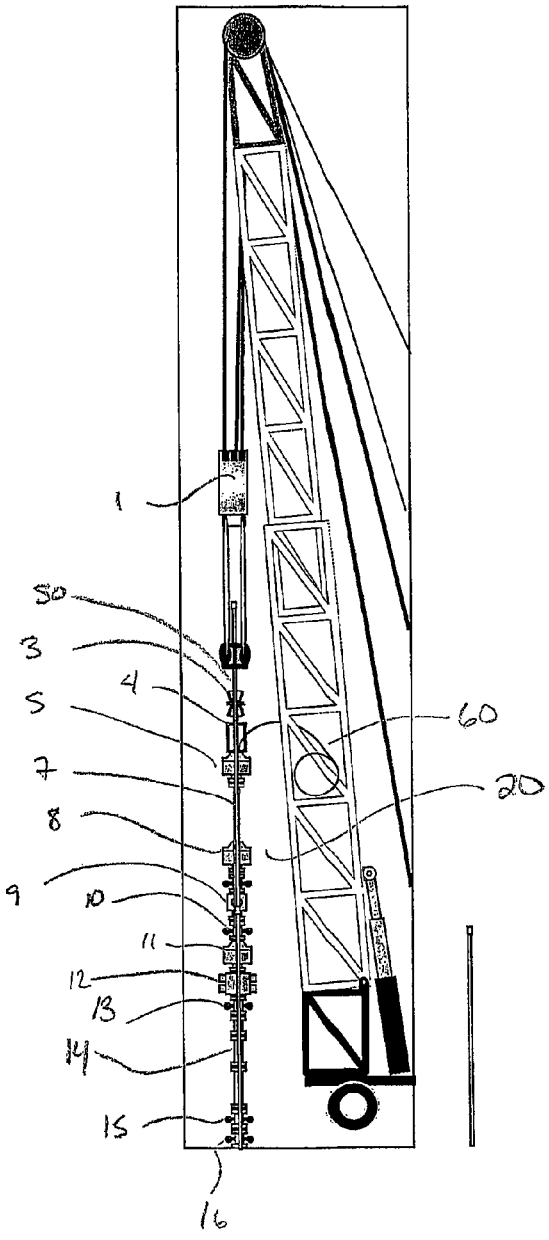

At step 110 the BOP stack 20 can be expanded. The lower slips 3 can be used to hoist the section of pipe string 50 out of the BOP stack 20 as shown in FIG. 5. This can raise the section of pipe string 50, the cable 60, the upper BOP 5, the ported spool 6 and the scoping spool 7. The rig block 1 must follow the section of pipe string 50. The intermediate BOP 8, single gate BOP 9, lower BOP 11, double gate BOP 12, ported spool 13, plurality of spacer spools 14 and ported spool 15 will remain in place with the scoping spool 7 being stripped through the intermediate BOP 8.

Figure 6:
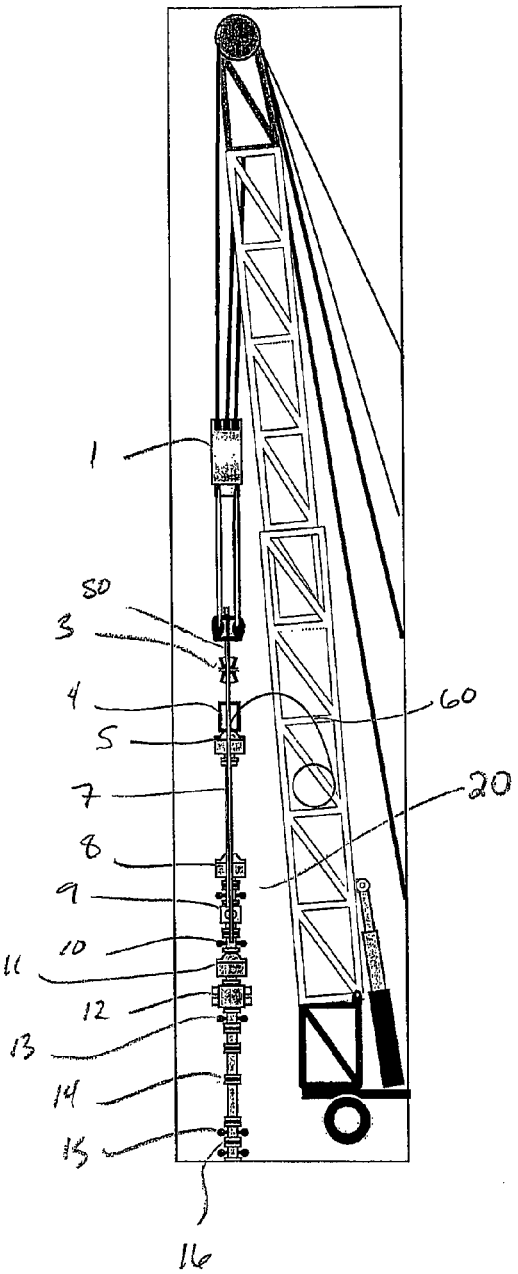

At step 115, when the section of pipe string 50 is at the top of the stroke, as shown in FIG. 6, the weight of the pipe string 50 can be taken with the rigs block 1. The lower BOP 11 can be closed, and the pressure in the interior of the BOP stack 20 in the annulus around the pipe string 50 between the upper BOP 5 and the lower BOP 11 can be bled off using one of the ported spools 6, 10.

Figure 7:
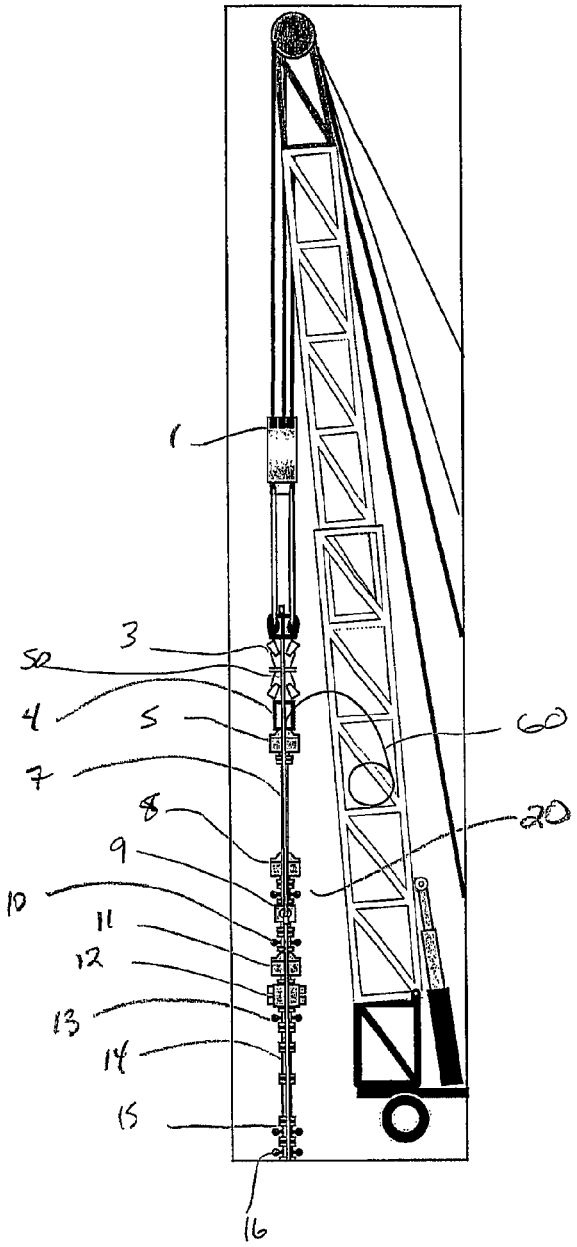

At step 120 with the pressure in the BOP stack 20 between the upper BOP 5 and the lower BOP 11 bled off, the upper BOP 5 can be opened and the lower slips 3 can be opened, as shown in FIG. 7.

Figure 8:
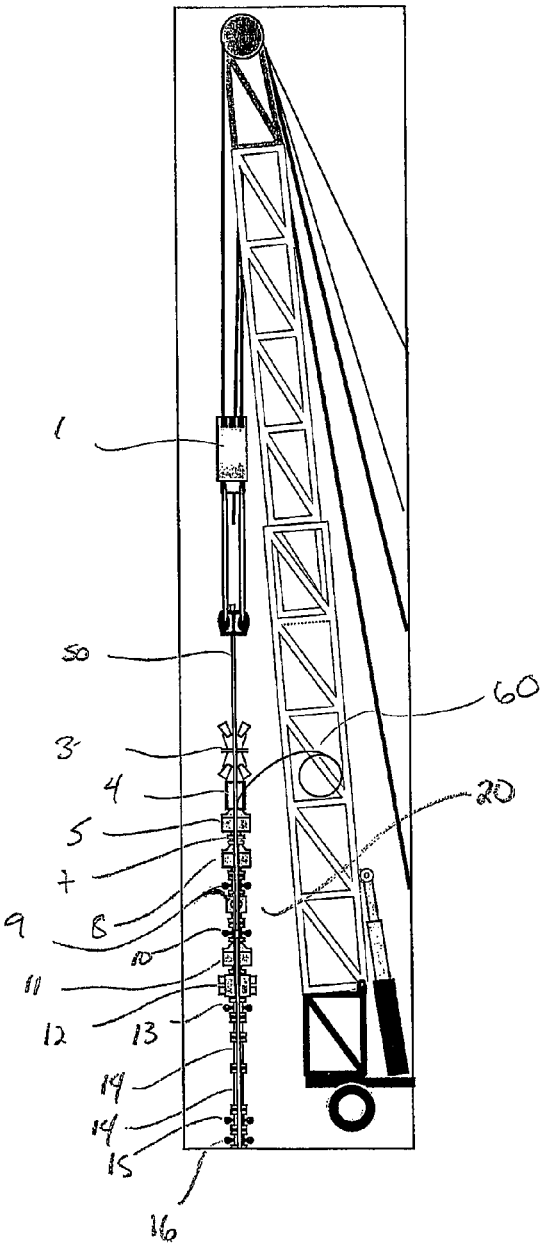

At step 125, the BOP stack 20 can be contracted. The BOP stack 20 can be lowered using the lower slips 3, as shown in FIG. 8. The upper BOP 5, the ported spool 6 and the scoping spool 7 can be lowered downwards while the intermediate BOP 8, single gate BOP 9, lower BOP 11, double gate BOP 12, ported spool 13, plurality of spacer spools 14 and ported spool 15 remain in substantially stationary. The scoping spool 7 will slide through the intermediate BOP 8.

A cable 60 is often run along the outside of the pipe string 50. In the production wells for SAGD operations a submersible pump is provided downhole to carry heavy oil collected in the production well up to the ground surface. The cable 60 may be a power cable to run power to the pump. This cable 60 must be taken off the outside of the section of pipe string 50 at step 125. An operator can access the outside of the section of the pipe string 50 through the access window 4 to remove the cable 60 from the outside of the section of pipe string 50 and spooled up or cut.

Figure 9:
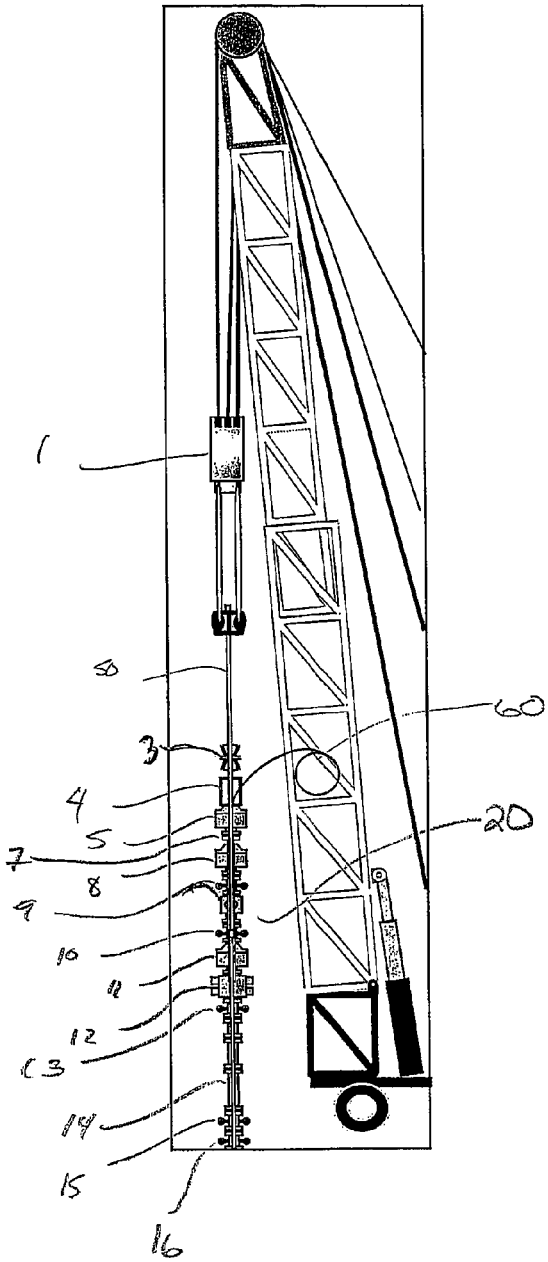

Once the BOP stack 20 is in the contracted position, at the bottom of the stroke, as shown in FIG. 9, step 130 can be performed and the BOP stack 20 reset. The upper BOP 5 can be closed and the pressure between the upper BOP 5 and the lower BOP 11 equalized. With the pressure between the upper BOP 5 and the lower BOP 11 equalized, the lower BOP 11 can be opened placing the interior of the BOP stack 20 in fluid communication with the well.

At the end of step 130, the BOP stack 20 is now back to the original, contracted position that it was in starting out in step 105.

Steps 105 through 130 can be repeated to remove the necessary amount of pipe string from the well.

Using method 100, the section of pipe section 50 can be cooled with a cooling gas in the BOP stack 20, reducing the pipe section 50 to a manageable level, before pulling the section of pipe string 50 out of the BOP stack 20. In one test, this method was able to cool a portion of pipe string from 260° C. to 65° C.

To snub the section of pipe string 50 back into the well using the BOP stack 20 the steps of method 100 can simply be reversed and the lower slips 3 used to force the section of pipe string 50 back into the well rather than pull the section of pipe string 50 out of the well.

Figure 10:
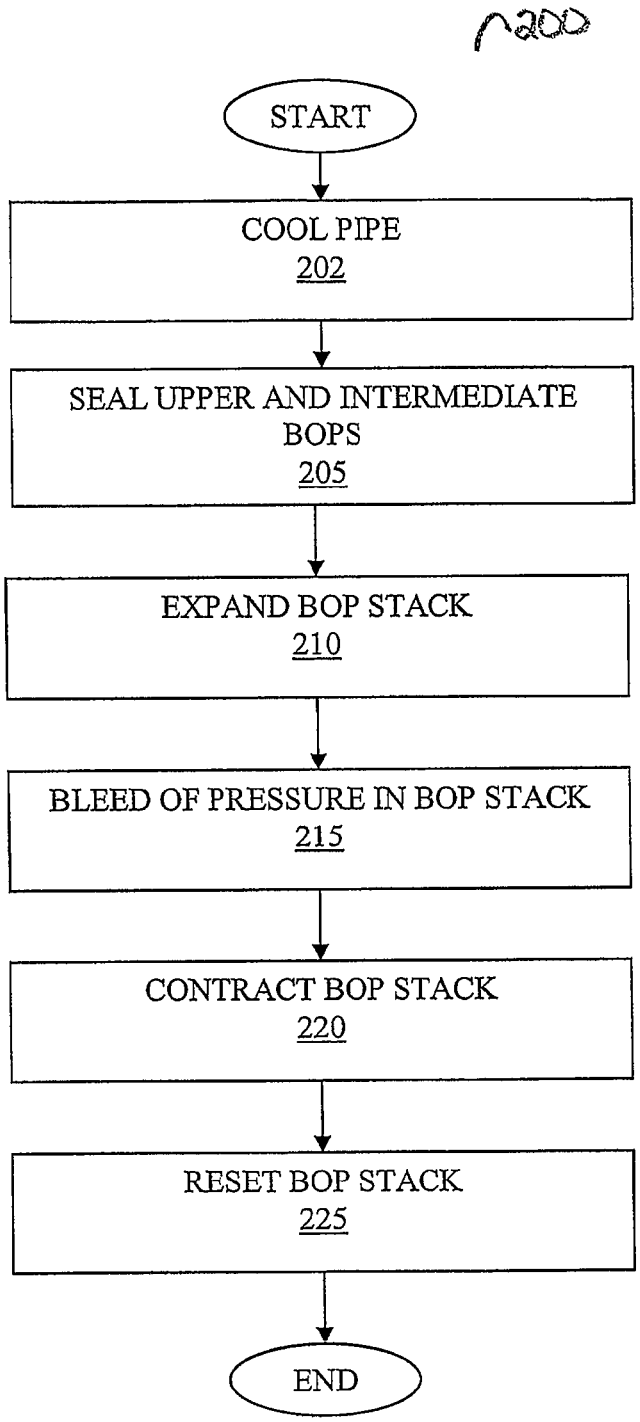
FIG. 10 is a flow chart of a method for snubbing a section of pipe string from a SAGD well in a pipe light situation.

Method 100 can be used when the pipe string is in a pipe heavy situation, i.e. the weight of the pipe string is greater than the force of the pressure on the pipe string from the well. However, in some cases, with the well being pressurized, the weight of the pipe string can be less than the force of the pressure from the well on the pipe string causing the pipe string to want to move upwards out of the well. In these cases, the method of snubbing the pipe string must be varied. FIG. 10 illustrates a flowchart of a method 200 for snubbing a pipe string out of a SAGD well in a pipe light situation.

At step 202 the section of pipe string 50 can be cooled, as shown in FIG. 3, with cooling gas routed through the ported spool 6 through the interior of the BOP stack 20 and around the pipe string 50, to be removed at the ported spool 15 proximate the bottom of the BOP stack 20.

Figure 11:
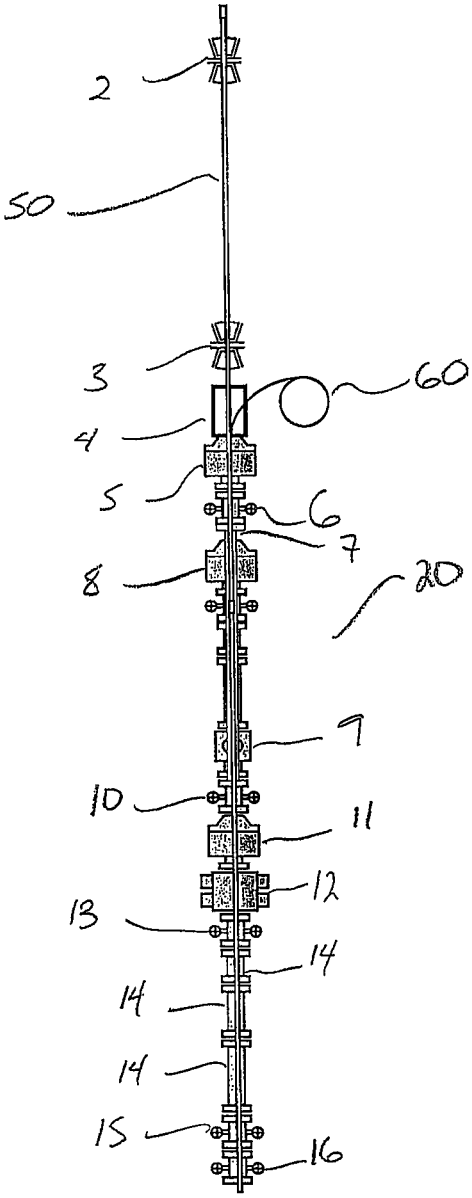
FIGS. 11-15 illustrate the steps of the method shown in FIG. 10.

With the section of pipe string 50 cooled at step 202, the method 200 can move to step 205 shown in FIG. 11. The upper BOP 5 should be sealed to the pipe string 50 and the intermediate BOP 8 should be sealed to the scoping spool 7. The remaining BOP units should be open, with the single gate BOP 9, the lower BOP 11, and the double gate BOP 12 open, allowing the interior of the BOP stack 20 to be in fluid communication with the well.

Figure 12:
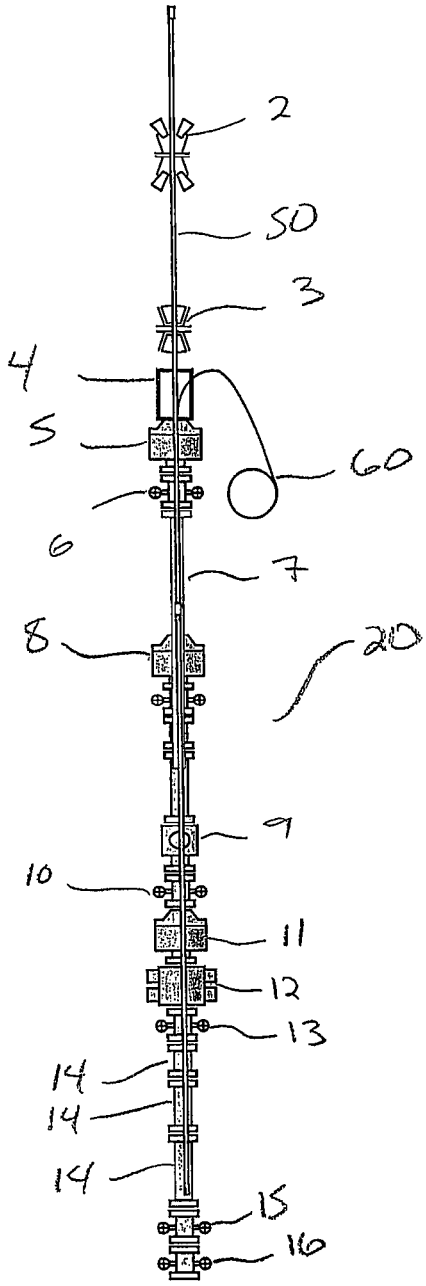

At step 210 the BOP stack 20 can be expanded. The upper slips 2 can be opened so that it is not secured around the section of pipe string 50 and the section of pipe string 50 can then be raised using the lower slips 3 as shown in FIG. 12. The work window 4, upper BOP 5, ported spool 6 and scoping spool 7 can be raised with the lower slips 3 and the section of pipe string 50 while the intermediate BOP 8, single gate BOP 9, ported spool 10, lower BOP 11, double gate BOP 12, ported spool 13, plurality of spacer spools 14 and ported spool 15 remain stationary. The scoping spool 7 is stripped through the intermediate BOP 8.

Figure 13:
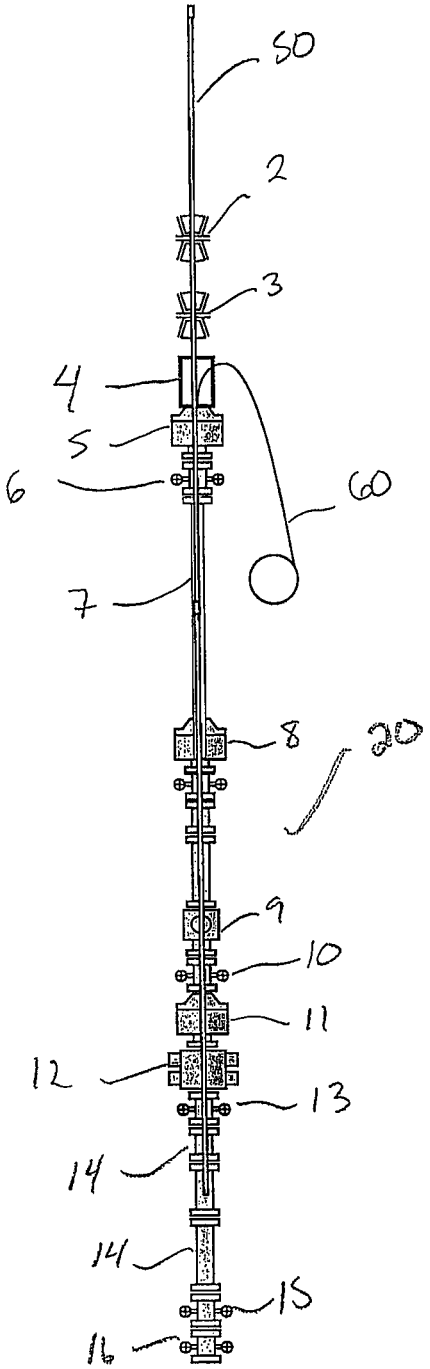

When the BOP stack 20 reaches the top of its stroke, reaching an expanded position, as shown in FIG. 13, step 215 can be performed. The upper slips 2 can be secured around the section of pipe string 50. The lower BOP 11 can then be opened to isolate the interior of the BOP stack 20 from the well and the pressure in the interior of the BOP stack 20 between the upper BOP 5 and the lower BOP 11 bled off using one of the ported spools 6, 10.

Figure 14:
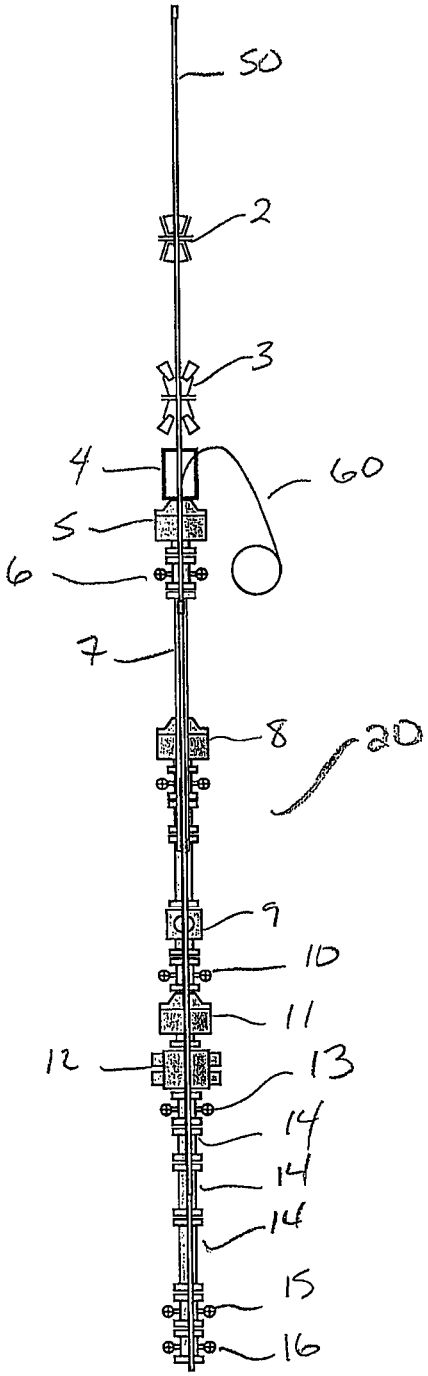

At step 220 the upper BOP 5 and lower slips 3 can be opened and the BOP stack 20 lowered to the bottom of its stroke as shown in FIG. 14. The work window 4, upper BOP 5, ported spool 6 and scoping spool 7 can be lowered using the lower slips 3 while the intermediate BOP 8, single gate BOP 9, ported spool 10, lower BOP 11, double gate BOP 12, ported spool 13, plurality of spacer spools 14 and ported spool 15 remain stationary. The scoping spool 7 can slide through the intermediate BOP 8.

If A cable 60 is present running along the outside of the pipe string 50, the cable 60 can be removed from the section of pipe string 50 at step 220 and spooled up or cut.

Figure 15:
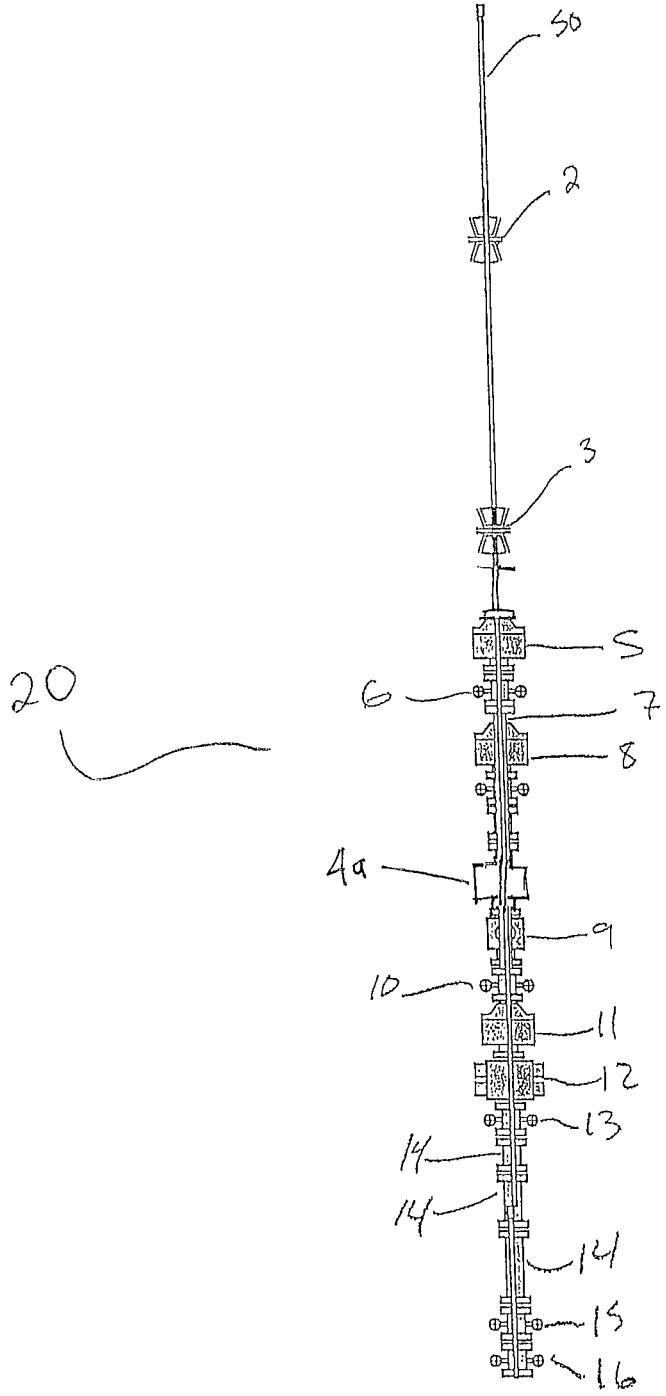

At step 225 the lower slips 3 can be closed and secured around the pipe string 50 and the upper BOP 5 can be closed around the pipe string 50 as shown in FIG. 15. The pressure between the upper BOP 5 and the lower BOP 11 can then be equalized before the lower BOP 11 is opened placing the interior of the BOP stack 20 in fluid communication with the well.

Steps 202-225 can be repeated to remove the necessary amount of pipe string from the well.

To snub the section of pipe string 50 back into the SAGD well using the BOP stack 20 the steps of method 200 can simply be reversed and the upper slips 2 and lower slips 3 used to force the section of pipe string 50 back into the well rather than pull the section of pipe string 50 out of the well.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claim.

The invention claimed is:

1. An apparatus for cooling tubulars stripped from a well to temperatures suitable for handling at surface, comprising:

(a) a hanger for manipulating the tubulars;

(b) a sub-assembly below the hanger comprising:

a top annular BOP or seal;

(ii) a bottom annular BOP or seal below the top annular BOP or seal, the bottom annular BOP or seal being attached to and above a wellhead; and (iii) a chamber for receiving tubulars and associated equipment from the wellbore, the chamber being attached between the top annular BOP or seal and the bottom annular BOP or seal, and sealed by the BOPs or seals from wellbore pressures and atmospheric pressures, and (c) the chamber having an inlet port for injection of fluid coolant and an outlet port for exhausting fluid coolant wherein the chamber is expandable in length while sealed.

2. The apparatus of claim 1, the apparatus further comprising a work window in the chamber or above the top BOP or seal and below the hanger.

3. The apparatus of claim 2 where collecting and redeploying means is provided for cable removed or replaced from or to the tubing through the window during removal or reinjection of tubing from or to the wellbore with the wellbore being continuously sealed from atmosphere at surface.

4. A method of removing and cooling tubing from a wellbore under pressure isolating the tubing from atmosphere by flowing a coolant fluid under pressure within a chamber while isolating the tubing from atmosphere and the wellbore, and exposing the tubing to the coolant fluid, comprising the steps of:

(a) attaching a hanger to the tubing in the wellbore using the hanger and associated service rig equipment to strip the tubing from the wellbore through an apparatus having at least a first annular BOP or seal above the wellbore, a chamber above the first BOP or seal to hold the tubing, a second annular BOP or seal above the chamber and below the hanger, the chamber having ports to receive and exhaust the coolant, the tubing having sufficient dwell time within the coolant to reduce the temperature of the tubing by an amount to accommodate further operations on the tubing; and (b) stripping the tubing further from the apparatus to above the second BOP or seal for further operations where the chamber has capacity to expand along the length of the tubing, and where a work window is provided above the second BOP or seal but below the hanger to permit removal of cabling from the tubing once the tubing is cooled during stripping, the method further comprising:

(c) fully extending the expandable chamber while cooling the tubing during stripping;

(d) stopping stripping operations;

(e) contracting the expandable chamber while removing cabling from the tubing as the cabling is exposed to the work window during contraction;

(f) resuming stripping and simultaneously expanding the chamber until fully expanded while cooling a new section of the tubing; and (g) repeating as necessary.

5. The method of claim 4 whereby the tubing is reduced in temperature to 65 degrees C. or less.

6. The method of claim 4 whereby the temperature of the tubing is reduced by more than 150 degrees C.

* * * * *